US010106346B2

(12) United States Patent
Mizuguchi

(10) Patent No.: US 10,106,346 B2
(45) Date of Patent: Oct. 23, 2018

(54) IMAGE FORMING APPARATUS

(71) Applicant: KYOCERA Document Solutions Inc., Osaka (JP)

(72) Inventor: Keisuke Mizuguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/594,723

(22) Filed: May 15, 2017

(65) Prior Publication Data

US 2017/0336746 A1 Nov. 23, 2017

(30) Foreign Application Priority Data

May 20, 2016 (JP) ..... 2016-101449

(51) Int. Cl.

| | |
|---|---|
| ***B65H 3/06*** | (2006.01) |
| ***B65H 1/02*** | (2006.01) |
| ***B65H 1/14*** | (2006.01) |
| ***G03G 15/00*** | (2006.01) |
| ***B65H 3/52*** | (2006.01) |

(52) U.S. Cl.

CPC ..... *B65H 3/06* (2013.01); *B65H 1/025* (2013.01); *B65H 1/14* (2013.01); *B65H 3/0669* (2013.01); *B65H 3/0684* (2013.01); *B65H 3/5223* (2013.01); *G03G 15/6511* (2013.01); *B65H 2402/30* (2013.01); *B65H 2403/60* (2013.01); *G03G 15/6529* (2013.01)

(58) Field of Classification Search

CPC .... B65H 3/0684; B65H 3/46; B65H 2404/15; B65H 2404/1521; B65H 2515/10; B65H 2515/112; G03G 15/6511

See application file for complete search history.

(56) References Cited

U.S. PATENT DOCUMENTS

| | | | | |
|---|---|---|---|---|
| 7,404,555 | B2 * | 7/2008 | Yonemoto | B65H 1/14 271/145 |
| 2006/0180980 | A1 * | 8/2006 | Yonemoto | B65H 1/14 271/10.11 |

FOREIGN PATENT DOCUMENTS

| | | |
|---|---|---|
| JP | 2008-056462 A | 3/2008 |

* cited by examiner

*Primary Examiner* — Michael C McCullough

(74) *Attorney, Agent, or Firm* — Studebaker & Brackett PC

(57) ABSTRACT

An image forming apparatus includes a first side plate, a second side plate and a sheet feeding unit. The first and second side plates are opposite to each other. The sheet feeding unit is attached between the first and second side plates. The sheet feeding unit has a feed frame, a pickup roller, a feed roller, a separation member and a weight member. The feed frame has a first side wall supported by the first side plate in a facing manner and a second side wall supported by the second side plate in a facing manner. The pickup roller and the feed roller are supported in the feed frame. The separation member forms a nip and separates the sheet at the nip. The weight member is disposed above the feed roller in the feed frame and configured to damp vibration of the feed frame.

8 Claims, 6 Drawing Sheets

IMAGE FORMING APPARATUS

INCORPORATION BY REFERENCE

This application is based on and claims the benefit of priority from Japanese Patent application No. 2016-101449 filed on May 20, 2016, which is incorporated by reference in its entirety.

BACKGROUND

The present disclosure relates to an image forming apparatus including a sheet feeding unit which feeds a sheet.

In an image forming apparatus, such as a copying machine and a printer, a sheet is fed from a sheet feeding cassette to an image forming part by a sheet feeding unit. The sheet feeding unit includes a feed member and a separation member. The feed member feeds the sheet stored in the sheet feeding cassette. The separation member comes into pressure contact with the feed member to convey an uppermost sheet only.

The separation member is configured to apply friction resistance to the sheets other than the uppermost sheet and to prevent the stacked sheets to be conveyed (prevent the multiple feeding). If stick slip occurs between the separation member and the sheet when the sheet passes through a space between the feed member and the separation member, the separation member and the sheet are vibrated. Then, the vibration is transmitted to the sheet feeding cassette and the others to generate abnormal sound.

In order to prevent the generation of abnormal sound, in some cases, a weight member as a member to restrain the transmission of vibration is mounted to the sheet feeding cassette to which the separation member is attached.

However, although the weight member makes it possible to prevent the vibration of the sheet feeding cassette, it is not sufficient to restrain the transmission of vibration to the feed member which comes into contact with the separation member. If the vibration is transmitted to the feed member, the vibration may be transmitted to a holder which supports the feed member, a feed frame which supports the holder, and a side plate which supports the feed frame. Then, theses member are also vibrated to generate abnormal sound. In order to prevent the generation of abnormal sound, the holder, the feed frame and the side plate may be formed so as to have high rigidity. However, this causes increase in cost.

In addition, in order to restrain the vibration of a relatively large size member, such as the sheet feeding cassette, it is required to increase a weight of the weight member and to increase the number of the weight member. This causes increase in cost.

SUMMARY

In accordance with an aspect of the present disclosure, an image forming apparatus includes a first side plate, a second side plate, a sheet feeding unit and an image forming part. The first side plate and the second side plate are opposite to each other. The sheet feeding unit is attached between the first side plate and the second side plate. The image forming part forms an image on a sheet fed by the sheet feeding unit. The sheet feeding unit has a feed frame, a pickup roller, a feed roller, a separation member and a weight member. The feed frame has a first side wall supported by the first side plate in a facing manner and a second side wall supported by the second side plate in a facing manner. The pickup roller is supported in the feed frame and configured to feed the sheet in a conveying direction. The feed roller is supported at a downstream side of the pickup roller in the conveying direction in the feed frame and configured to convey the fed sheet in the conveying direction. The separation member is configured to come into contact with the feed roller to form a nip and to separate the sheet at the nip. The weight member is disposed above the feed roller in the feed frame and configured to damp vibration of the feed frame.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus according to an embodiment of the present disclosure will be described.

Figure 1:
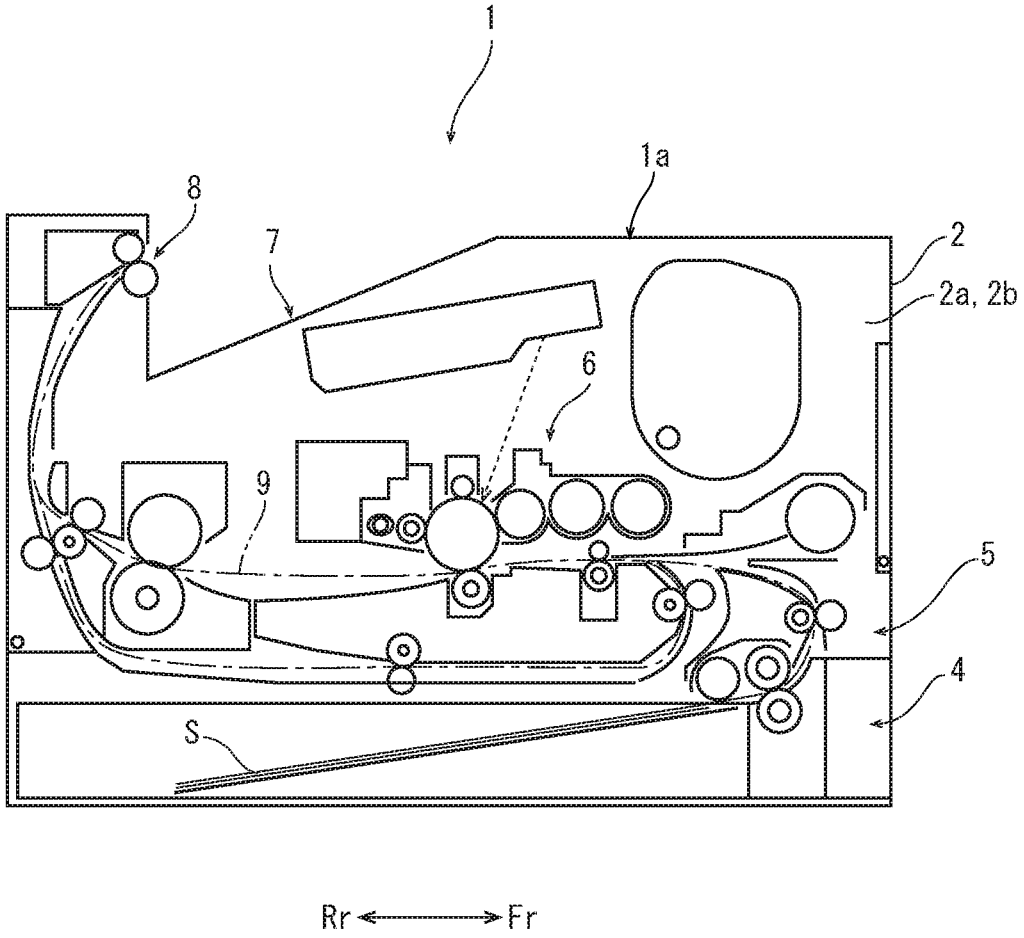
FIG. 1 is a side view schematically showing an inner structure of a printer according to an embodiment of the present disclosure.

With reference to FIG. 1, a printer 1 as an image forming apparatus will be described. FIG. 1 is a view schematically showing the printer according to the embodiment of the present disclosure. In the following description, front and rear directions shown in FIG. 1 are respectively set as front and rear directions of the printer 1, and left and right directions are based on a direction in which the printer 1 is seen from the front side. Fr, Rr, L and R shown in each figure respectively show the front, rear, left and right sides.

An apparatus main body la of the printer 1 includes a box-shaped casing 2. The casing 2 includes a pair of first and second side plates 2*a* and 2*b* opposing to each other in the left and right directions (refer to FIG. 4 and FIG. 5 also). In a hollow space of the casing 2, a sheet feeding unit 5 configured to feed a sheet S, an image forming part 6 configured to form an image on the sheet S and a sheet ejection device 8 configured to eject the sheet S on an ejection tray 7 are stored. In addition, the apparatus main body 1*a* has a conveying path 9 along which the sheet S is conveyed from the sheet feeding unit 5 to the sheet ejection device 8 through the image forming part 6. The conveying path 9 is formed so as to extend from a front end portion of the sheet feeding unit 5 forward in an upper oblique direction, to curve rearward and then to curve forward in an upper oblique direction after passing through the image forming part 6.

The sheet S fed by the sheet feeding unit 5 is conveyed along the conveying path 9, formed with an image at the image forming part 6 and then ejected on the ejection tray 7 by the ejection device 8.

Figure 2:
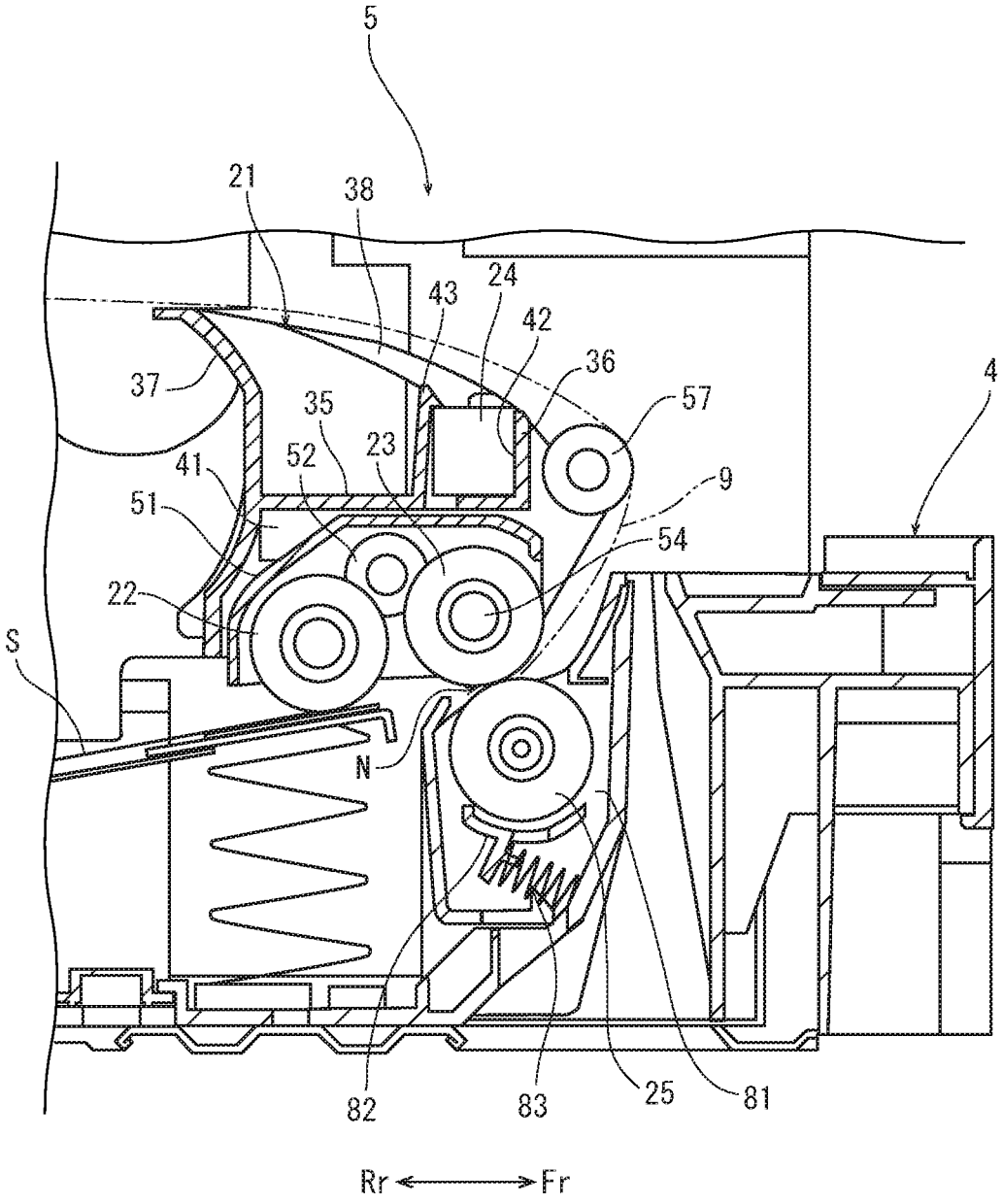
FIG. 2 is a side sectional view showing a sheet feeding unit of the printer according to the embodiment of the present disclosure.
Figure 3:
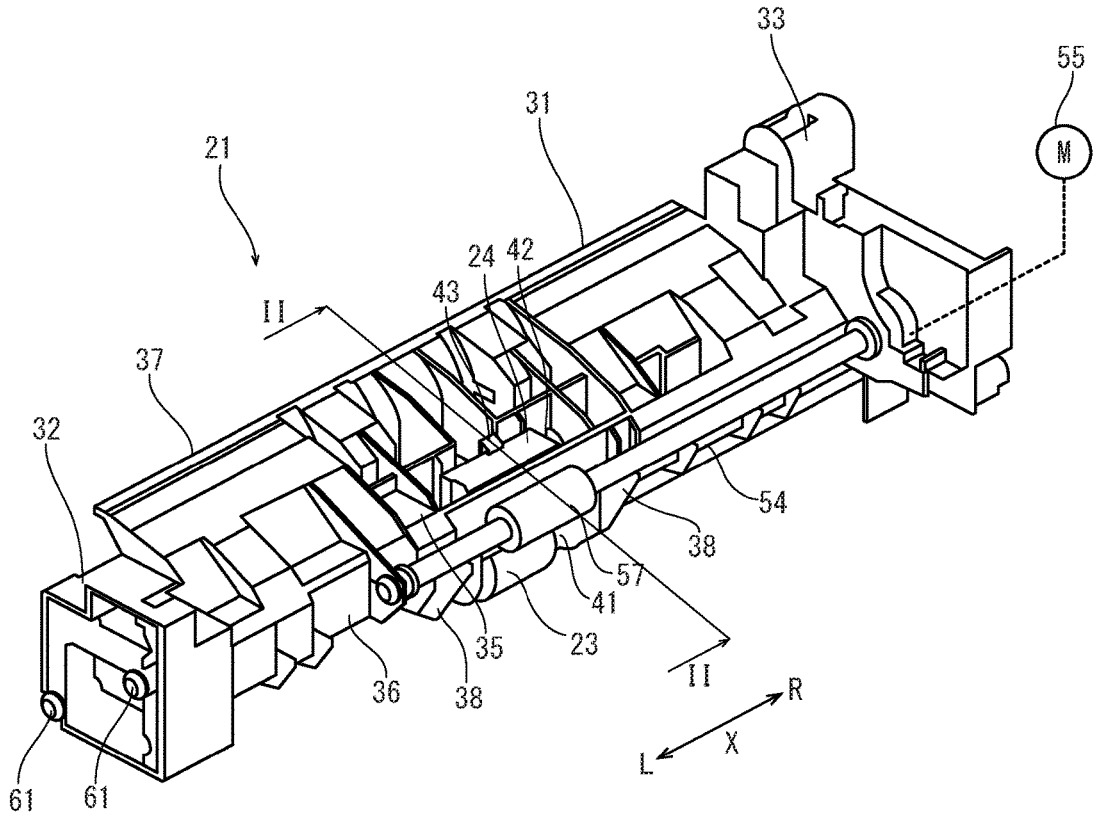
FIG. 3 is a perspective view showing a feed frame of the sheet feeding unit, in the printer according to the embodiment of the present disclosure.

Next, with reference to FIG. 2 and FIG. 3, the sheet feeding unit 5 will be described. FIG. 2 is a side sectional view showing the sheet feeding unit and FIG. 3 is a perspective view showing a feed frame. The side sectional view of the feed frame shown in FIG. 2 is taken along a line II-II of FIG. 3.

As shown in FIG. 2, the sheet feeding unit 5 includes a sheet feeding cassette 4 as a sheet placing part on which the sheets S are placed and a feed frame 21 provided above a front end portion of the sheet feeding cassette 4. The sheet feeding unit 5 further includes a pickup roller 22, a feed roller 23, a weight member 24 and a retard roller 25. The pickup roller 22, the feed roller 23 and the weight member 24 are supported by the feed frame 21. The pickup roller 22 is configured to feed the sheet S from the sheet feeding cassette 4. The feed roller 23 is configured to convey the fed sheet S along the conveying path 9. The weight member 24 is disposed above the feed roller 23. The retard roller 25 is supported by the sheet feeding cassette 4. The retard roller 25 as a separation member configured to separate the sheet S is disposed at the front end portion of the sheet feeding cassette 4 so as to come into pressure contact with the feed roller 23.

As shown in FIG. 3, the feed frame 21 includes a main body 31 provided along a width direction (shown by X in FIG. 3) perpendicular to a sheet conveying direction, and a first and second side walls 32 and 33 disposed at both ends of the main body 31 in the width direction (both ends in the left and right directions).

As shown in FIG. 2, the main body 31 has a horizontal base plate 35, a front plate 36 provided along a front edge of the base plate 35 and a rear plate 37 provided along a rear edge of the base plate 35. The main body 31 has a plurality of ribs 38 arranged at predetermined intervals in the width direction. These ribs 38 forms a guide face curved rearward by approximately 180 degrees. Along the guide face, the sheet S is guided from the front end portion of the sheet feeding cassette 4 to the image forming part 6.

On a center in the width direction of a lower face of the base plate 35, a pair of blocks are protruded at a predetermined interval in the width direction. Between the blocks, a lower storage recess 41 opened to a lower side is formed. On an upper face of the base plate 35, an upper storage recess 42 opened to an upper side is formed above a front half portion of the lower storage recess 41 (a downstream side position in the conveying direction). In the upper storage recess 42, a hook part 43 is formed so as to extend upward from the base plate 35. The hook part 43 is deformable forward around its lower end connected to the base plate 35.

The pickup roller 22 and the feed roller 23 are supported by a feed holder 51. The pickup roller 22 and the feed roller 23 are arranged in the order from the upstream side in the conveying direction, and both ends of their rotating shafts are rotatably supported by the holder 51. At one ends of the rotating shafts, gears (not shown) are fixed. An idle gear 52 which is meshed with the gears is rotatably supported by the feed holder 51.

The feed holder 51 is detachably attached to the lower storage recess 41. As shown in FIG. 3, when the feed holder 51 is attached to the lower storage recess 41, a right end portion of a drive shaft 54 to which the feed roller 23 is fixed is coupled to a drive source 55 at the second side wall 33 directly or via a transmitting shaft.

When the drive shaft 54 is rotated, the feed roller 23 is rotated in the counterclockwise direction in FIG. 2. In addition, the pickup roller 22 is rotated in the counterclockwise direction in FIG. 2 via the idle gear 52 to feed the sheet S stored in the sheet feeding cassette 4 in the sheet conveying direction.

The weight member 24 is stored in the upper storage recess 42. The weight member 24 has a cuboid shape, and is made of metal, for example. The weight member 24 has a weight of 40 g, for example. By elastically deforming the hook part 43, the weight member 24 is detachably attached to the upper storage recess 42.

An intermediate roller 57 is rotatably attached to the front plate 36 of the main body 31 at the center in the width direction. Left and right end portions of a rotating shaft of the intermediate roller 57 are rotatably supported by the rib 38 and the second side wall 33 respectively.

As shown in FIG. 3, on an outer face of the first side wall 32, two positioning pins 61 are formed. On an outer face of the second side wall 33, three positioning pins (refer to FIG. 5 as described later) and two screw holes 64 (refer to FIG. 5 as described later) are formed.

Figure 4:
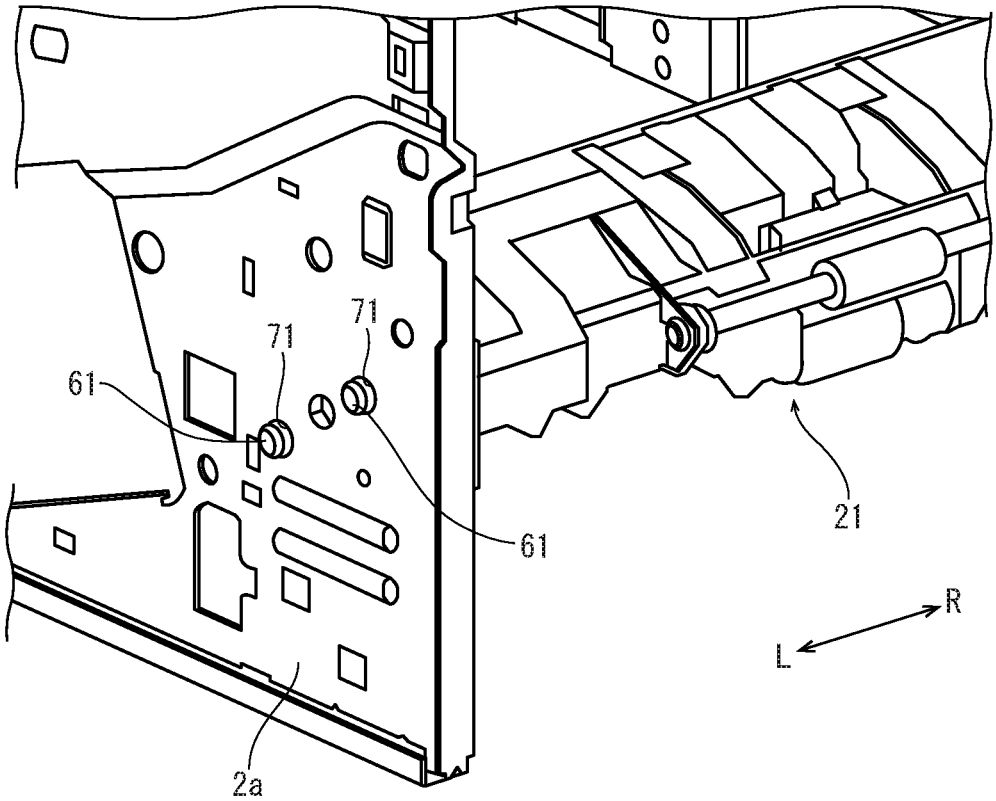
FIG. 4 is a perspective view showing a first side plate and the feed frame, in the printer according to the embodiment of the present disclosure.
Figure 5:
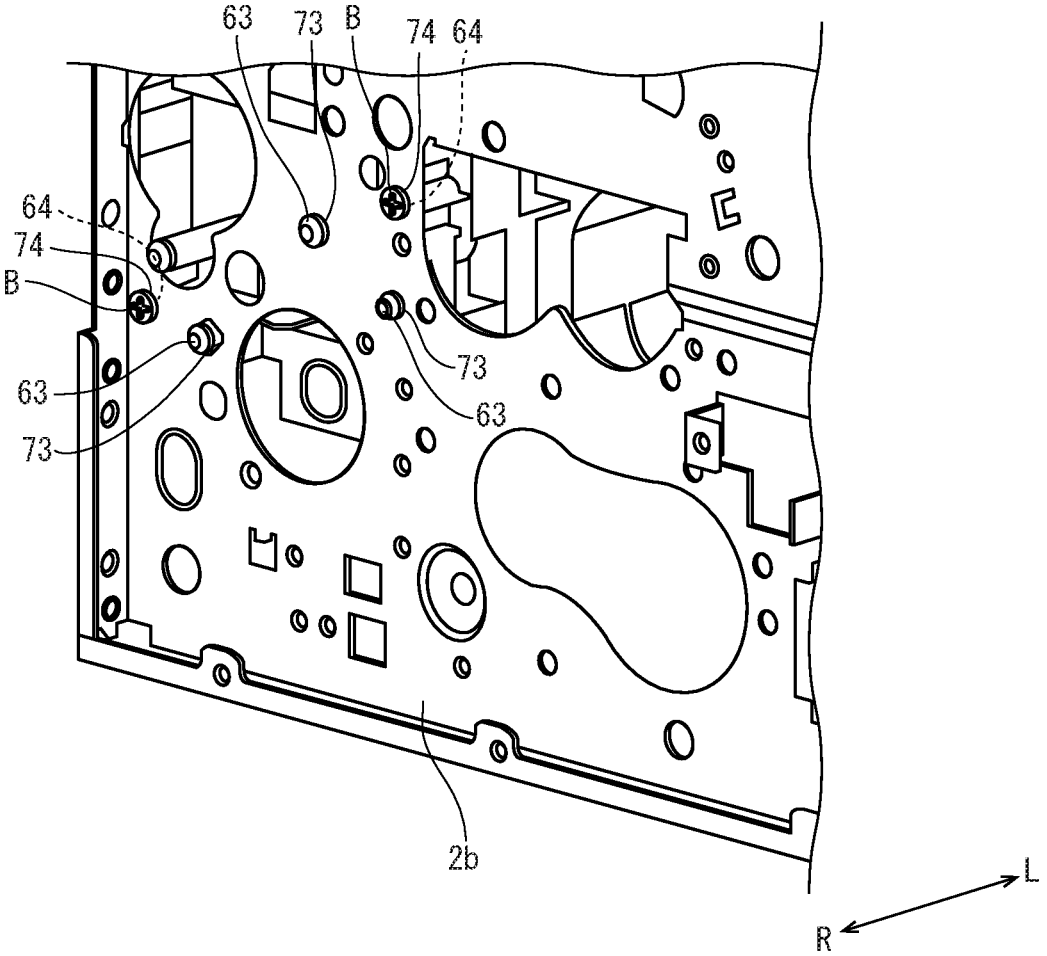
FIG. 5 is a perspective view showing a second side plate and the feed frame, in the printer according to the embodiment of the present disclosure.
Figure 6:
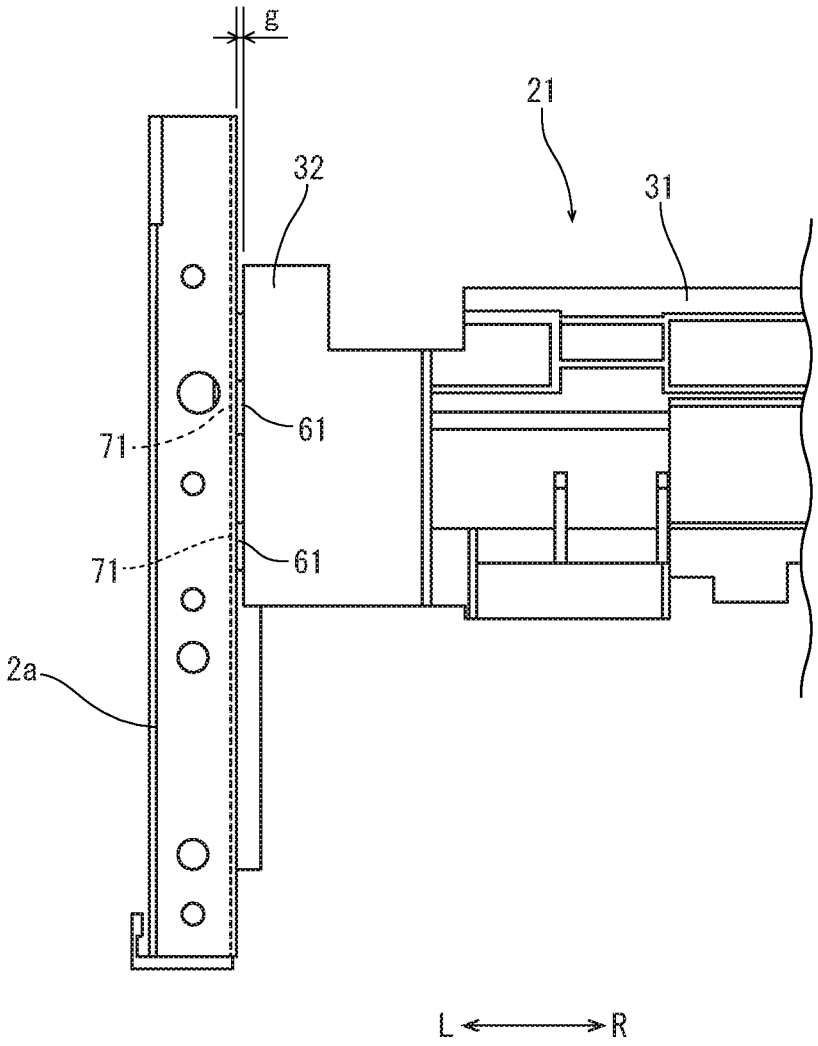
FIG. 6 is a front view showing the first side plate and the feed frame, in the printer according to the embodiment of the present disclosure.

Next, with reference to FIG. 4 to FIG. 6, the feed frame 21, the first side plate 2*a* and the second side plate 2*b* will be described. FIG. 4 is a perspective view showing the first side wall of the feed frame and the first side plate. FIG. 5 is a perspective view showing the second side wall of the feed frame and the second side plate. FIG. 6 is a front view showing the first side wall of the feed frame and the first side plate. The feed frame 21 is supported to the apparatus main body la such that the first and second side walls 32 and 33 respectively face the first and second side plate 2*a* and 2*b*.

As shown in FIG. 4, the first side plate 2*a* has two positioning holes 71 corresponding to the two positioning pins 61 of the first side wall 32. The two positioning pins 61 are loosely fitted into the two positioning holes 71.

As shown in FIG. 5, the second side plate 2*b* has three positioning holes 73 corresponding to the three positioning pins 63 of the second side wall 33 and two through holes 74 corresponding to the two screw holes 64 of the second side wall 33. The three positioning pins 63 are loosely fitted into the three positioning holes 73. Two screws B are penetrated through the two through holes 74 and screwed with the two screw holes 64. Thereby, the second side wall 33 is fastened to the second side plate 2*b*.

In addition, as shown in FIG. 6, between the first side plate 2*a* and the first side wall 32, a gap g is formed. An interval of the gap g is 1 mm, for example.

With reference to FIG. 2 again, the retard roller 25 is rotataby supported by a retard holder 82. The retard holder 82 is supported by a storage recess 81 formed at the front end portion of the sheet feeding cassette 4 so as to be turnable and to be turned upward by a coil spring 83. Thereby, the retard roller 25 comes into pressure contact with the feed roller 23 from the lower side to form a separation nip N between the both rollers. The retard roller 25 has a torque limiter. The torque limiter is configured to stop the rotation of the retard roller 25 until a torque larger than a predetermined value is applied to the retard roller 25 and to idle the retard roller 25 with respect to its rotating shaft when the torque applied to the retard roller 25 exceeds the predetermined value.

In the sheet feeding unit 5 having an above described configuration, when the sheet is fed from the sheet feeding cassette 4, the pickup roller 22 feeds the uppermost sheet to the separation nip N. If one sheet S is fed, the sheet S is conveyed by friction resistance between the feed roller 23 and an upper face of the sheet S. In this time, friction force between the retard roller 25 and a lower face of the sheet S exceeds the predetermined value of the torque limiter, the retard roller 25 rotates as the sheet S is conveyed. Thereby, the sheet S is conveyed by the intermediate roller 57 to the image forming part 6.

If two or more sheets S are fed, the uppermost sheet S is conveyed by the feed roller 23. Because friction force between the uppermost sheet S and the lower sheet is smaller than the friction force between the feed roller 23 and the uppermost sheet S, the torque applied to the retard roller 25 does not exceed the predetermined value of the torque limiter. Thereby, the retard roller 25 is not rotated, and the lower sheet is not conveyed. In this way, the two or more sheets S is separated one by one and the uppermost sheet only is conveyed by the intermediate roller 57 to the image forming part 6.

When the sheet S fed by the pickup roller 22 passes through the separation nip N, if stick slip occurs between the retard roller 25 and the sheet S, the retard roller 25 is vibrated. The vibration of the retard roller 25 is transmitted to the feed roller 23 through the sheet S. Then, the vibration is transmitted to the first and second side plate 2*a* and 2*b* through the feed holder 51 and the feed frame 21. Here, because the weight member 24 is stored in the upper storage recess 42 of the feed frame 21, the vibration transmitted from the feed holder 51 to the feed frame 21 is damped. Especially, an amplitude of the vertical component among the vibration components can be made small. In addition, because a weight of the feed frame 21 increases, a specific frequency of the feed frame 21 shifts toward lower frequencies, and resonance of the feed frame 21 can be inhibited.

In addition, although the second side plate 2*b* and the second side wall 33 of the feed frame 21 are fastened with the screws B as shown in FIG. 5, the first side plate 2*a* and the first side wall 32 of the feed frame 21 are not fastened and the positioning pins 61 of the first side wall 32 are loosely fitted into the positioning holes 71 of the first side plate 2*a* as shown in FIG. 4. Furthermore, as shown in FIG. 6, between the first side plate 2*a* and the first side wall 32, the gap g is formed. The gap g is set so as to keep a predetermined interval even if a dimensional error in the first and second side plates 2*a* and 2*b* and the feed frame 21 is varied. Accordingly, the vibration is hardly transmitted to the first side plate 2*a* from the feed frame 21.

As described above, according to the sheet feeding unit 5 of the present disclosure, because the weight member 24 is arranged above the feed roller 23 disposed adjacently the retard roller 25 as a vibration generating source, the vertical component among the vibration components of the feed roller 23 can be damped intensively. In addition, because the weight member 24 is arranged at the center in the width direction, the vibration damping effects can be improved. Accordingly, by using the small and light weight member 24, it makes possible to efficiently reduce the abnormal sound caused by the stick slip occurred between the retard roller 25 and the sheet S.

Because the weight member 24 can be detachably stored in the upper storage recess 42 opened to the upper face by the hook part 43, the weight of the weight member 24 can be easily adjusted.

The first side plate 2*a* and the first side wall 32 of the feed frame 21 are not fastened; but the positioning pins 61 of the first side wall 32 are loosely fitted into the positioning holes 71 of the first side plate 2*a*. In addition, between the first side plate 2*a* and the first side wall 32, the gap is formed. Thereby, the transmission of the vibration from the feed frame 21 to the first side plate 2*a* can be damped. Accordingly, the generation of abnormal sound can be prevented without increase in cost by heightening the rigidity of the feed frame 21 and the first and second side plate 2*a* and 2*b*. By supporting the first side wall 32 of the feed frame 21 to the first side plate 2*a* with the positioning pins 61 and the positioning holes 71, it becomes possible to make the first side wall 32 of the feed frame 21 to be supported by the first side plate 2*a* with the gap g.

In addition, by combining the damping of the vibration of the feed roller 23 by the weight member 24 and the prevention of the vibration transmission between the first side plate 2*a* and the first side wall 32 of the feed frame 21, a synergistic effect for the abnormal sound can be obtained, and the inexpensive sheet feeding unit 5 which hardly generates abnormal sound can be provided.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. An image forming apparatus comprising:

a first side plate and a second side plate opposing to each other;

a sheet feeding unit attached between the first side plate and the second side plate; and an image forming part which forms an image on a sheet fed by the sheet feeding unit, wherein the sheet feeding unit includes:

a feed frame having a first side wall supported by the first side plate in a facing manner and a second side wall supported by the second side plate in a facing manner;

a pickup roller supported in the feed frame and configured to feed the sheet in a conveying direction;

a feed roller supported at a downstream side of the pickup roller in the conveying direction in the feed frame and configured to convey the fed sheet in the conveying direction;

a separation member configured to come into contact with the feed roller to form a nip and to separate the sheet at the nip; and a weight member disposed above the feed roller in the feed frame and configured to damp vibration of the feed frame, wherein the second side plate and the second side wall are fastened to each other with a fastening member, and the first side plate and the first side wall are not fastened to each other.

2. The image forming apparatus according to claim 1, wherein either one of the first side plate and the first side wall has a positioning pin and the other of the first side plate and the first side wall has a positioning hole into which the positioning pin is penetrated.

3. The image forming apparatus according to claim 2, wherein a predetermined gap is formed between the first side plate and the first side wall in a width direction perpendicular to the conveying direction.

4. The image forming apparatus according to claim 1, wherein the sheet feeding unit includes a drive shaft which rotates the feed roller, the drive shaft is supported by the second side wall and coupled to a drive source mounted on the second side plate.

5. The image forming apparatus according to claim 1, wherein the weight member is detachable to the feed frame.

6. The image forming apparatus according to claim 1, wherein the weight member has a cuboid shape and is made of metal.

7. An image forming apparatus comprising:

a first side plate and a second side plate opposing to each other;

a sheet feeding unit attached between the first side plate and the second side plate; and an image forming part which forms an image on a sheet fed by the sheet feeding unit, wherein the sheet feeding unit includes:

a feed frame having a first side wall supported by the first side plate in a facing manner and a second side wall supported by the second side plate in a facing manner;

a pickup roller supported in the feed frame and configured to feed the sheet in a conveying direction;

a feed roller supported at a downstream side of the pickup roller in the conveying direction in the feed frame and configured to convey the fed sheet in the conveying direction;

a separation member configured to come into contact with the feed roller to form a nip and to separate the sheet at the nip; and a weight member disposed above the feed roller in the feed frame and configured to damp vibration of the feed frame, wherein the feed frame has:

a base plate;

an upper storage recess provided on the base plate and having an opened upper face, the weight member being detachably stored in the upper storage recess;

a hook part formed so as to extend upward from the base plate and configured to be deformable around its lower end which is connected to the base plate, the hook part holds the weight member stored in the upper storage recess.

8. The image forming apparatus according to claim 7, wherein the feed frame has a feed holder to which the pickup roller and the feed roller are rotatably supported, the feed frame has a lower storage recess opened to a lower side, the lower storage recess being configured to support the feed holder, and the upper storage recess is disposed above a downstream side position of the lower storage recess in the conveying direction.

* * * * *